US007192264B2

(12) United States Patent
Viitamäki

(10) Patent No.: US 7,192,264 B2
(45) **Date of Patent: *Mar. 20, 2007**

(54) HYRDRAULIC MOTOR

(76) Inventor: Tapio Viitamäki, Lipastinkuja 12, Koskenkorva (FI)

( * ) Notice: Subject to any disclaimer, the term of this patent is extended or adjusted under 35 U.S.C. 154(b) by 27 days.

This patent is subject to a terminal disclaimer.

(21) Appl. No.: 10/511,141

(22) PCT Filed: Apr. 17, 2004

(86) PCT No.: PCT/FI2003/000314

§ 371 (c)(1),
(2), (4) Date: Oct. 14, 2004

(87) PCT Pub. No.: WO03/091545

PCT Pub. Date: Nov. 6, 2003

(65) Prior Publication Data

US 2005/0232801 A1 Oct. 20, 2005

(30) Foreign Application Priority Data

Apr. 24, 2002 (FI) ..... 20020793

(51) Int. Cl.
*F03C 2/00* (2006.01)
*F04C 18/00* (2006.01)

(52) U.S. Cl. ..... 418/265; 418/258; 418/261; 123/240; 123/242

(58) Field of Classification Search ..... 418/258, 418/261, 265; 123/240, 242
See application file for complete search history.

(56) References Cited

U.S. PATENT DOCUMENTS 2,366,765 A 1/1945 Anderson
2,581,172 A 1/1952 Carson
3,539,281 A 11/1970 Kramer
3,951,112 A * 4/1976 Hunter ..... 123/242
4,005,951 A * 2/1977 Swinkels ..... 418/256
4,177,024 A * 12/1979 Lohn ..... 418/270
5,558,511 A 9/1996 Hedelin
6,883,488 B2 * 4/2005 Viitamaki ..... 418/265
2001/0055538 A1 12/2001 Schneider et al.

FOREIGN PATENT DOCUMENTS

DE 447 701 7/1927
DE 201 13 784 U1 5/2002

* cited by examiner

*Primary Examiner*—Theresa Trieu
(74) *Attorney, Agent, or Firm*—Oliff & Berridge, PLC

(57) ABSTRACT

The invention relates to a hydraulic motor having an outer casing and eccentric means for rotating a power shaft by means of fluid through a pressure chamber arrangement. The eccentric means comprise an eccentric part formed in the power shaft, a first eccentric ring between the outer casing and an inner casing, and a second eccentric ring mounted with bearings around the eccentric part and connected fixedly and concentrically to the first eccentric ring, whereby the pressure chamber arrangement is located between the first eccentric ring and the inner casing so that the first eccentric ring drives the power shaft through the second eccentric ring, and the eccentric rings form a substantially non-rotating entity that only performs an eccentric movement and by means of this eccentric movement rotates the power shaft.

6 Claims, 11 Drawing Sheets

HYRDRAULIC MOTOR

BACKGROUND OF THE INVENTION

The invention relates to a hydraulic motor having a non-rotating annular outer casing, moving eccentric means inside the outer casing, a power shaft connected to the eccentric means and rotatable thereby, a pressure chamber arrangement communicating with the eccentric means for moving the eccentric means and thus rotating the power shaft by means of hydraulic fluid, steam or pressurized air led into and removed from the pressure chamber arrangement, and a non-rotating annular inner casing inside the non-rotating annular outer casing.

In principle, hydraulic motors are the opposite of hydraulic pumps. They change hydraulic energy back to mechanical energy. In structure, hydraulic motors greatly resemble pumps and sometimes it is possible to use a hydraulic pump as a motor and vice versa. The matter should, however, be checked with the manufacturer of the pump or motor. Hydraulic motors work like pumps, i.e. using the displacement principle. The motors are controlled in an open hydraulic system by 4-way valves or a closed hydraulic system is used. In many cases, the motor can be made rotate in both directions. High torques and outlets with respect to their size characterize hydraulic motors. The start-up torques are 80 to 99% of the rated torque. The motors are well suited for demanding conditions, because the hydraulic system is tight and the heat generated in the motor is transmitted with a medium to a container. Hydraulic motors often have a separate leak connection that is connected to the container. The motors are either slow-speed 0 to 500 r/min (high torque) or high-speed 1,000 to 4,000 r/min (low torque). The most common hydraulic motor types are: gear motor, vane motor and piston motor.

This invention relates to vane motors. In known vane motors, a non-rotating stator forms the outer circumference of the motor. Inside the stator, there is a round chamber mounted with an eccentric rotor. The rotor has vanes at regular intervals that are sealed against the inner ring of the stator forming chambers between the stator and rotor. Pressurized hydraulic fluid is fed from one side of the stator to these chambers and correspondingly, the hydraulic fluid is removed from the other side of the stator, whereby the rotor is made to rotate. Known vane motors can be constant or adjustable in displacement. The adjustment is done by altering the eccentricity of the rotor. At low speeds of rotation, the pushing out of the vanes is ensured by means of springs. Vane motors are generally high-speed motors. Slowly rotating high-torque motors have also been constructed of them by increasing the rotor width by increasing the diameter and by adding pressure chambers, whereby the displacement can be increased.

Drawbacks with this and all other prior-art hydraulic motors include friction and wear problems of the rotating parts and the limited rotating rate, outlet and torque caused by this.

BRIEF DESCRIPTION OF THE INVENTION

It is an object of the invention to develop by using a vane motor as the starting point a completely new type of hydraulic motor, in which the above drawbacks can be entirely eliminated. This object is achieved by a hydraulic motor of the invention and of the type described in the beginning that is characterized in that the eccentric means comprise an eccentric part formed in the power shaft, a first eccentric ring between the outer casing and the inner casing, and a second eccentric ring mounted with bearings around the eccentric part of the power shaft and connected fixedly and concentrically to the first eccentric ring, whereby the pressure chamber arrangement is located between the first eccentric ring and the inner casing in such a manner that the first eccentric ring drives the power shaft through the second eccentric ring and the first and second eccentric rings form a substantially non-rotating entity that only performs an eccentric movement and makes the power shaft rotate by means of this eccentric movement.

The invention is thus based on an eccentric ring that drives a power shaft, does not rotate, but only performs an eccentric movement. The only rotating part is the above-mentioned power shaft with any possible balancing elements.

The considerable advantages provided by the solution of the invention are naturally the elimination of all the earlier problems causing wearing. The structure is also extremely simple in other respects, and a physically small motor can also generate significantly high outlets and torques. The rotating rate of the power shaft also does not have the same limitations as the limitations for the rotation of the rotor in the prior-art vane motors.

LIST OF FIGURES

The invention will now be described in greater detail by means of a preferred embodiment and with reference to the attached drawings, in which FIG. 1 shows the cross-section or radial section of a hydraulic motor of the invention, FIG. 2 shows the longitudinal or axial section of a hydraulic motor of FIG. 1, FIG. 3 shows the hydraulic motor of the previous figures as an exploded view, and with reference to FIGS. 1 to 3:

DETAILED DESCRIPTION OF THE INVENTION

Figure 1:
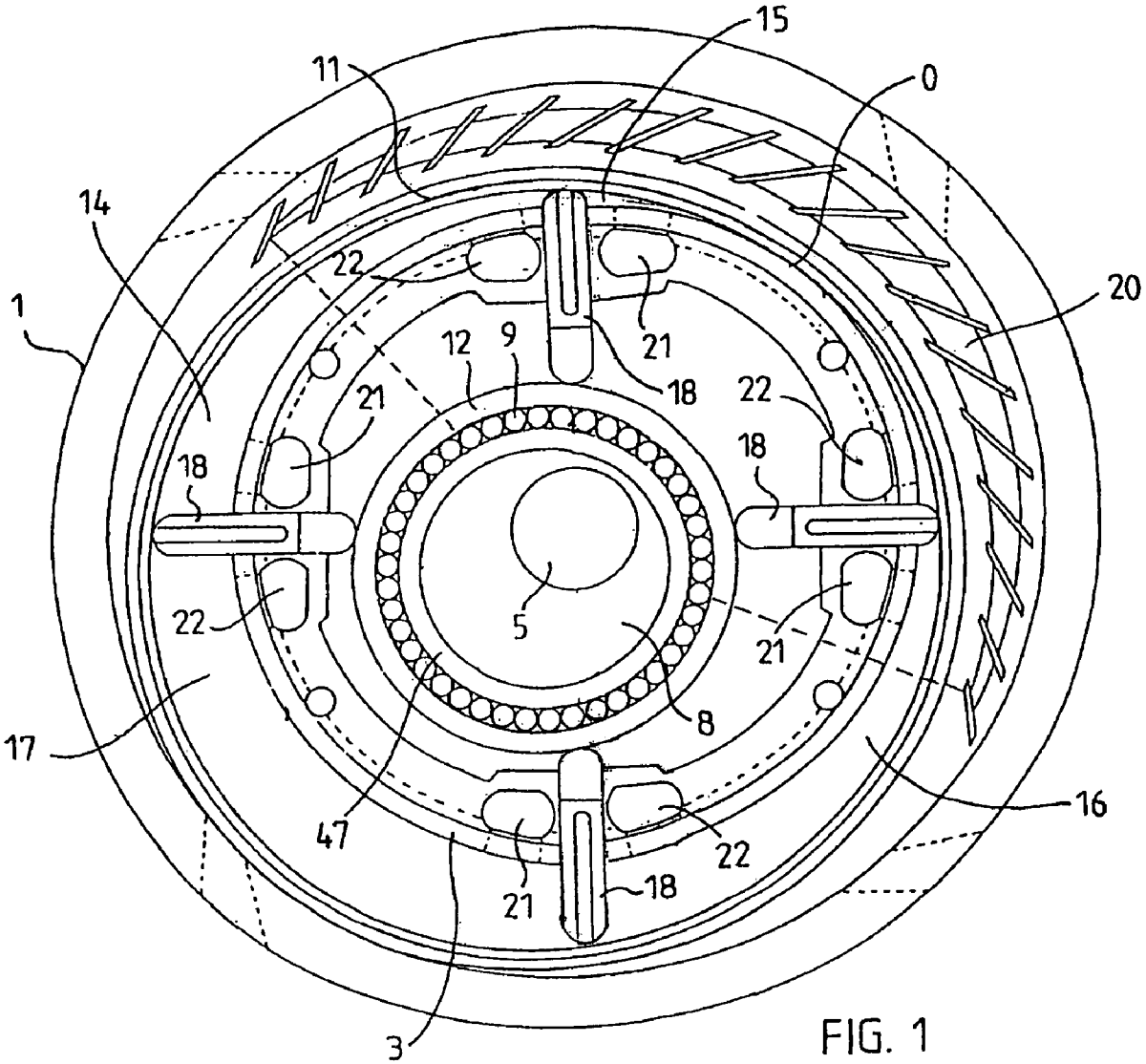
Figure 2:
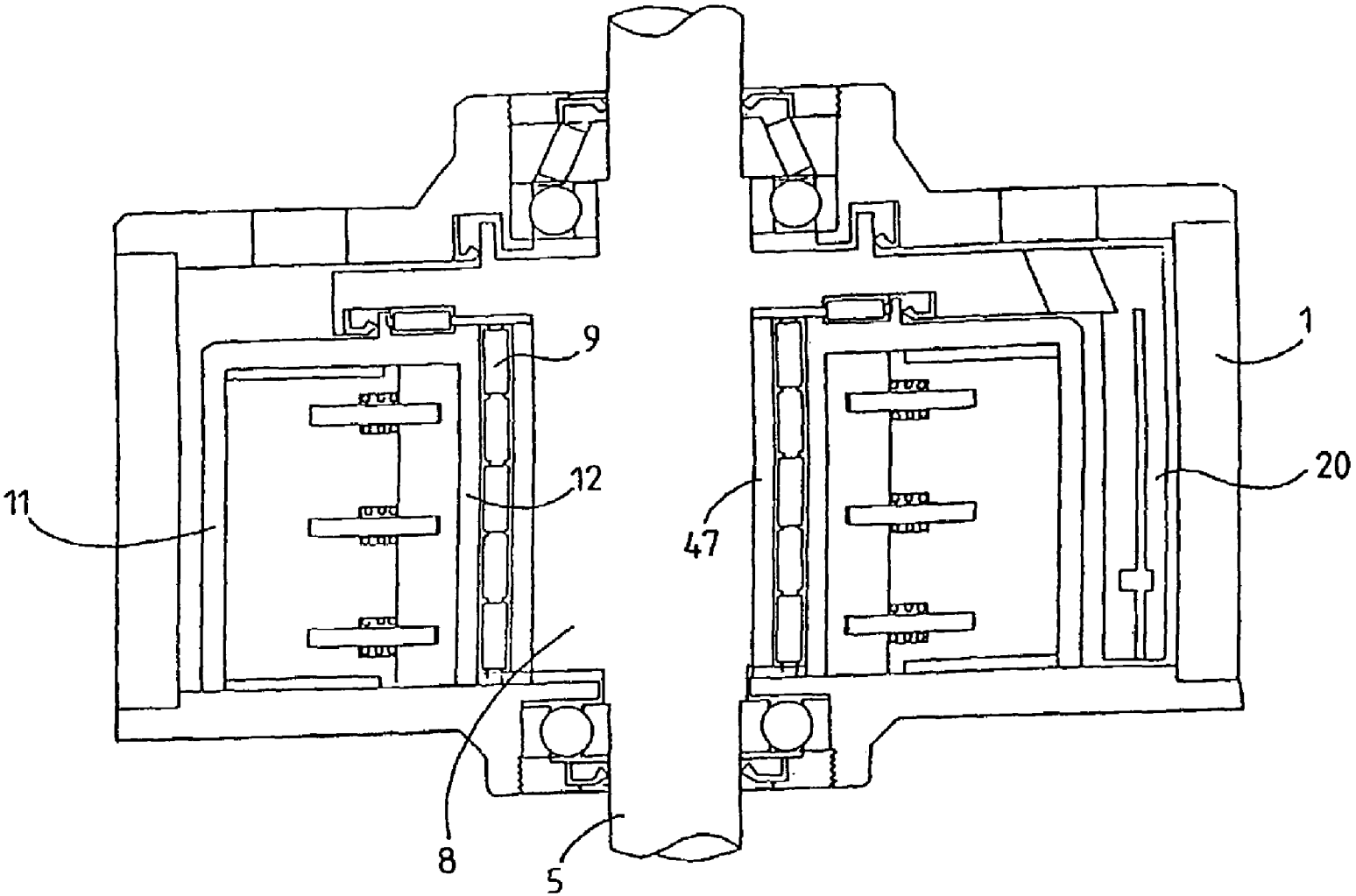
Figure 3:
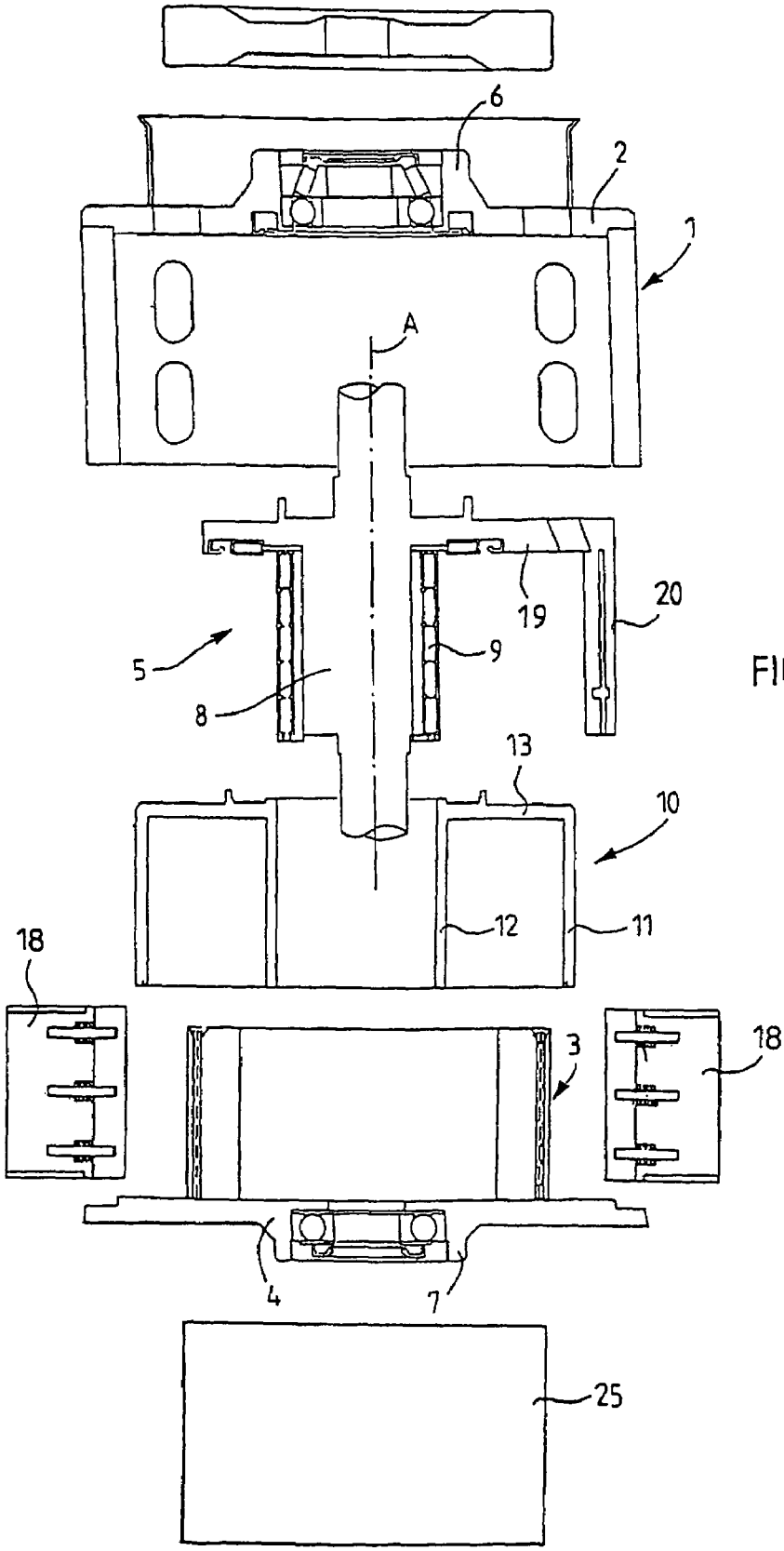

The hydraulic motor shown in FIGS. 1 to 3 has a non-rotating cylindrical outer casing 1 which is closed at one end with a first end plate 2, and a non-rotating inner casing 3 that is through a second end plate 4 located at one end thereof connected to one end of the outer casing 1. These components 1 to 4 primarily form the outermost parts of the motor.

The components 1 to 4 enclose firstly a power shaft 5 arranged inside the inner casing 3 and mounted with bearings 6 and 7 in relation to its centre line A coaxially in relation to the inner casing 3 to the end plates 2 and 4. The power shaft 5 has an eccentric part 8 that is essential for the operation of the motor and has a bearing 9 mounted on its surface. Said components 1 to 4 also enclose an eccentric ring arrangement 10 that is also essential for the operation of the motor and comprises a first cylindrical eccentric ring 11 arranged between the outer casing 1 and the inner casing 3, and a second cylindrical eccentric ring 12 that is mounted on the eccentric part 8 of the power shaft 5 with the above-mentioned bearing 9. The eccentric rings 11 and 12 are coaxial and connected to each other at one end with an end ring 13.

The eccentric ring arrangement 10 is substantially a non-rotating entity that only performs an eccentric movement and by means of the eccentric movement rotates the power shaft 5.

To drive the eccentric ring 11, a pressure chamber arrangement 14 to 17 is arranged between it and the inner casing for leading hydraulic fluid, steam or pressurized air thereto. In the following, the term hydraulic fluid is used, but the 'fluid' can also be steam or pressurized air depending on the application of the hydraulic motor. In this example, the pressure chamber arrangement is divided into four equal-sized parts 14 to 17 and this is done specifically by means of divider means 18 arranged through the inner casing 3 that are arranged in close contact with the inner surface of the driving eccentric ring 11 and the outer surface of the second eccentric ring 12 and to move radially in relation to the inner casing 3 guided by the eccentric rings 11 and 12 when the eccentric ring arrangement 10 performs its eccentric movement.

The operation of the motor is simply such that hydraulic fluid is fed between the eccentric ring 11 and inner casing 3, i.e. spaces 14 to 17 and specifically when their volumes are at their smallest, whereby said spaces begin to expand and the eccentric movement progresses in such a manner that the eccentric ring 11 pushes towards the outer casing 1 and the eccentric movement of the eccentric ring 11 progresses between the inner and outer casings 1 and 3. This eccentric movement is such that the contact points of the eccentric ring 11 with the casings 1 and 3 progress along the surfaces of the casings 1 and 3 in the rotating direction of the power shaft 5. That is, said contact points 'rotate', but the eccentric ring 11 does not rotate. This movement of the eccentric ring 11 in turn rotates (forces to rotate) the power shaft 5 by means of the second eccentric ring 12 mounted with bearings on the eccentric part 8 of the power shaft 5. The bearing 9 makes sure that the eccentric rings 11 and 12 do not rotate. This operation is described later in greater detail.

To balance the eccentric forces, a balancing arc 20 fastened through a flange 19 to the power shaft 5 is arranged between the outer casing 1 and the driving eccentric ring 11 at a distance from their surfaces, the arc being located on the opposite side of the power shaft 5 in relation to the eccentric part 8 of the power shaft 5. This arrangement makes sure that the arc 20 never touches the eccentric ring 11. By suitably dimensioning the mass of the balancing arc 20, the vibration caused by the eccentric movement can be eliminated.

Figure 4:
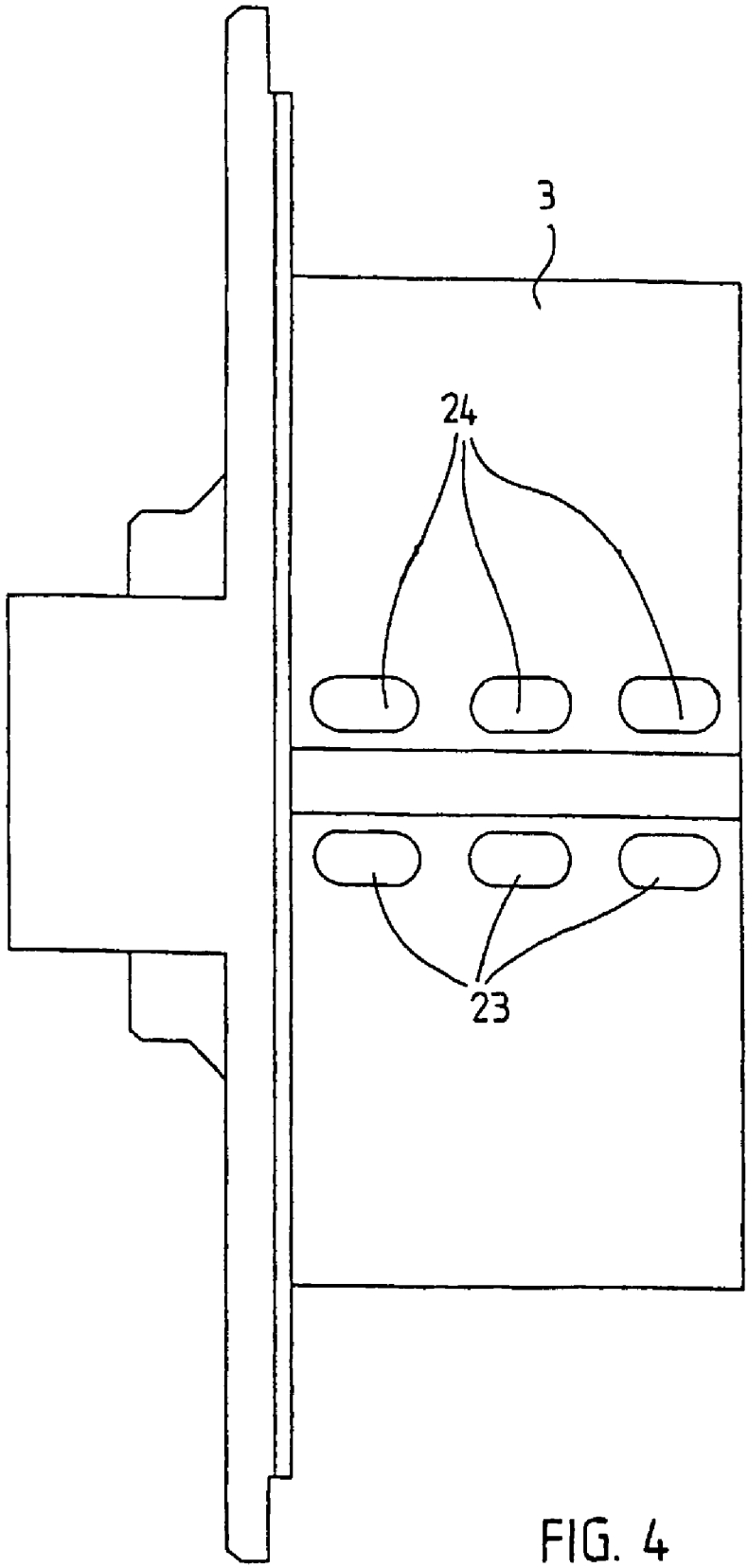
FIG. 4 shows the inner casing of the motor.

The feeding arrangement of hydraulic fluid comprises intake channels 21 and outlet channels 22 arranged to the inner casing 3. The intake channels 21 open into the chambers 14 to 17 in the direction of travel of the eccentric ring 11 or in the rotating direction of the power shaft 5 when seen immediately after each divider means 18, and the outlet channels 22 immediately before the divider means 18. Both the intake and outlet channels 21 and 22 can open into the chambers 14 to 17 as several, preferably parallel openings 23 and 24, as shown in FIG. 4.

Figure 5:
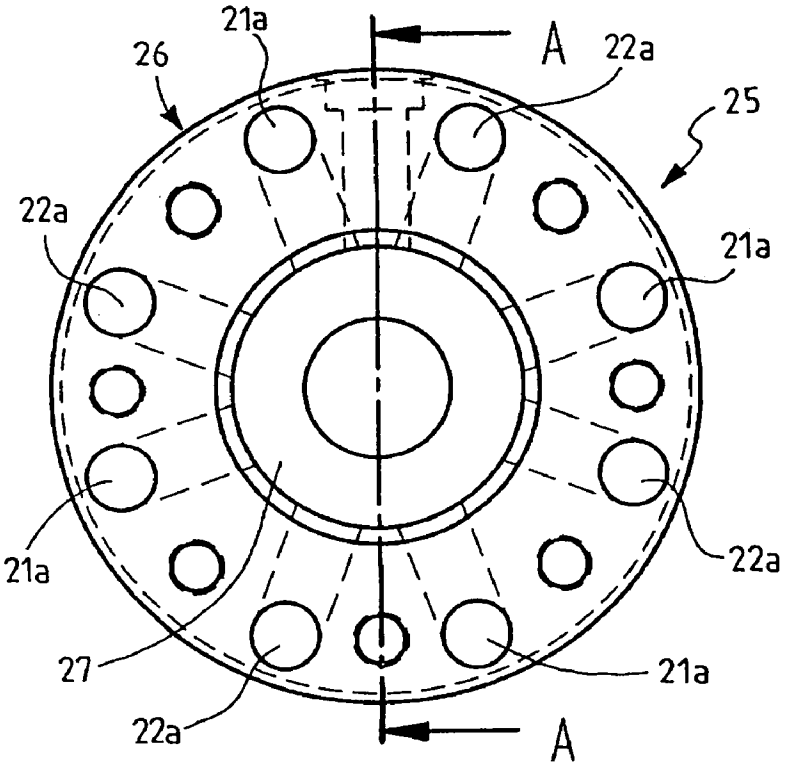
FIG. 5 is an end view of a feeding apparatus of the motor.
Figure 6:
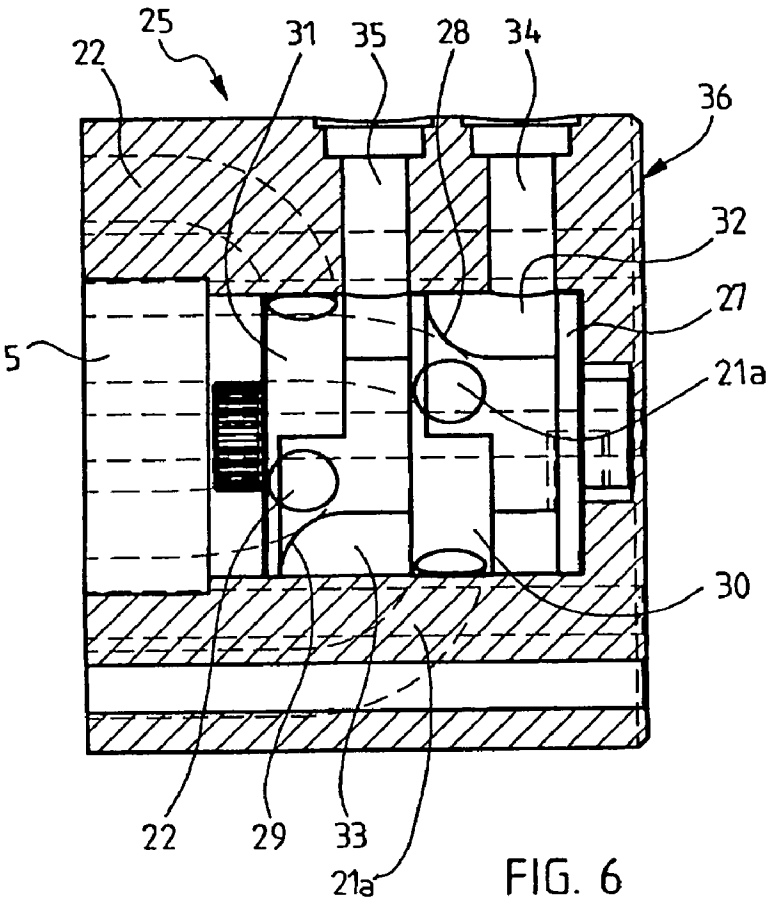
FIG. 6 is a sectional view of the feeding apparatus of the motor.

In FIGS. 5 and 6 in particular, to open and close the intake and outlet channels 21 and 22 of the feeding arrangement of hydraulic fluid and to feed hydraulic fluid into the intake channels 21 and discharge hydraulic fluid through the outlet channels 22 in a synchronized manner, a feeding apparatus 25 is fastened to the end plate 4 of the inner casing 3, and the channels 21 and 22 of the inner casing "continue" in the body 26 of the feeding apparatus as channels 21*a* and 22*a* and connect to a synchronizing drum 27 arranged rotatably inside the body 26 and receiving its driving power from the power shaft 5 and opens and closes the channels 21*a* and 22*a* by means of shaped 180-degrees long grooves 28 and 29 and 180-degrees long ring sections 30 and 31 between them in the synchronizing drum 27 in the order required by the operation of the motor. Between the feeding apparatus 25 body 26 and the synchronizing drum 27, there are ring channels 32 and 33 connected to the parts 28 to 31 and guided by the rotation of the synchronizing drum 27, the ring channels are connected to the intake and outlet channels 34 and 35 of hydraulic fluid that are connected to the hydraulic aggregate. When the synchronizing drum 27 rotates, the channels 34 and 35 are alternately connected to the channels 21*a* and 22*a* and correspondingly to channels 21 and 22 for the time required for intake and outlet stages. The operation of the synchronizing apparatus 25 is described in greater detail later in connection with the description of the operation of the following motor.

The feeding apparatus according to FIGS. 5 and 6 is designed to be simple and inexpensive to manufacture, but the motor does run with other types of feeding apparatuses, too. The feeding apparatus does not necessarily need to be mechanically operated, i.e. it can also be made up of pressure-controlled magnetic valves that operate on pulses received from the power shaft 5. This structure would be expensive, but possible, to build.

The divider means 18 is preferably made up of two main parts 36 and 37 that are connected to each other by means of pins 38. The pins 38 can slide in the parts 36 and 37, and springs 39 are arranged around the pins 38 between the parts 36 and 37 to distance the parts 36 and 37 from each other so as to make them press flexibly but tightly against the surfaces of the eccentric rings 11 and 12. In addition, the ends of the divider means 18 that touch said surfaces are rounded, especially due to the path of the eccentric ring 11. FIGS. 1 to 3 and 7 show an embodiment of such a simple divider means 18.

Figure 8:
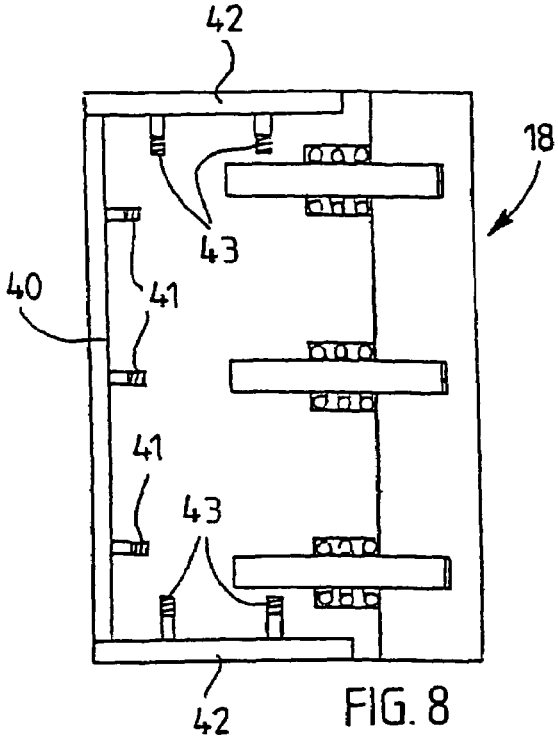
FIGS. 7 to 10 show a few embodiments of a divider of the motor.
Figure 9:
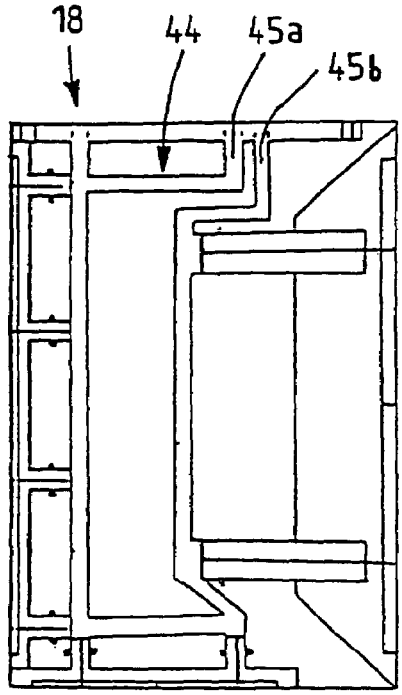
Figure 7:
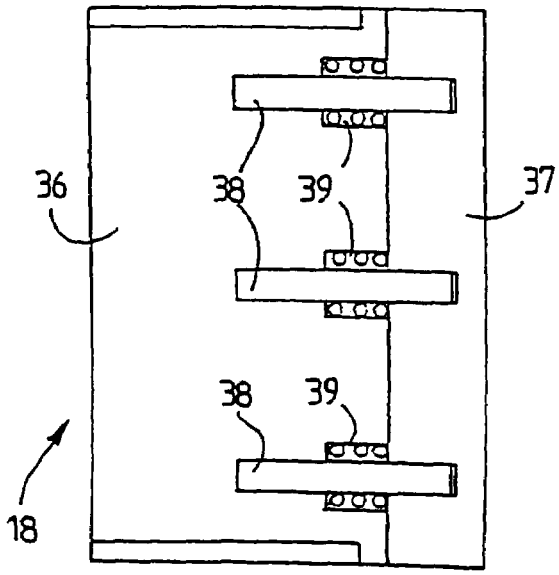

FIG. 8 shows a further development of the divider means 18 described above, in which the contact point 40 on the side of the eccentric ring 11 is a separate piece that is also forced outward by means of second springs 41. In addition, the edges 42 touching the side walls of the pressure chambers 14 to 17 are separate parts that are in turn forced towards the side by means of springs 43.

Figure 11:
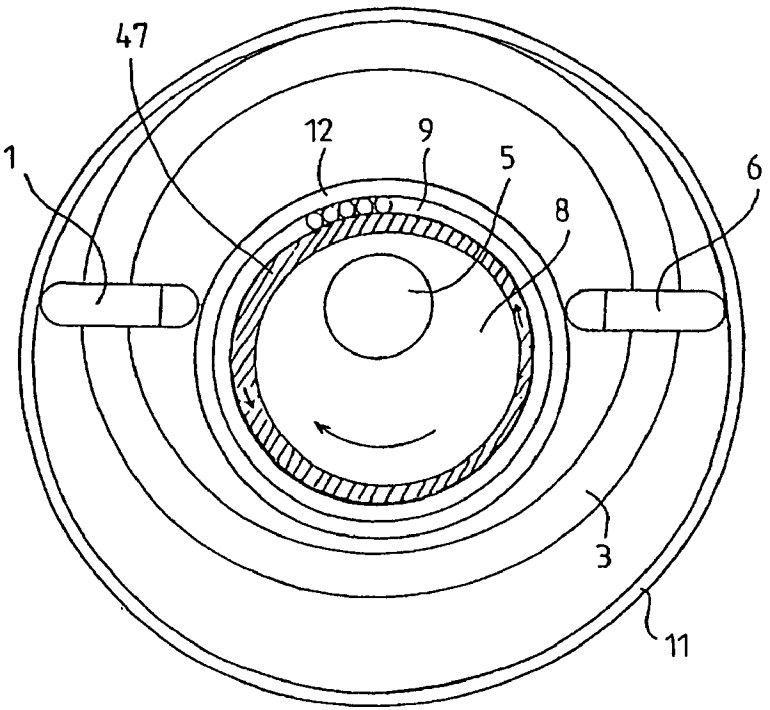
FIG. 11 shows the operation of a centre adjuster of the motor.

The sealing of the divider means 18 against the counter-surfaces can also be done hydraulically according to FIG. 11. In it, all spring forces described above can be replaced by oil pressure in an oil channel arrangement 44, for instance by leading oil in through a channel 45*a* and out through a channel 45*b*. The springs 39, 41 and 43 described above or some of them can also be kept in addition to this hydraulic action to obtain a tight sealing even at the start-up time of the motor when the oil pressure has not risen sufficiently.

Figure 10:
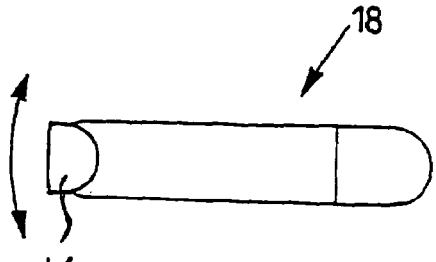

According to FIG. 10, a turning end 46 may be arranged to the divider means 18 against the surface of the eccentric element 11. The end 46 turns according to the path of the eccentric element 11 and guided by it. Owing to the larger contact surface of the eccentric element 11 and head 46, sealing is improved and lubrication facilitated, because the entire contact surface of the end 46 is always in contact with the inner surface of the eccentric element 11. Wearing is slight, because there is practically no relative sliding movement between said surfaces.

Figure 12:
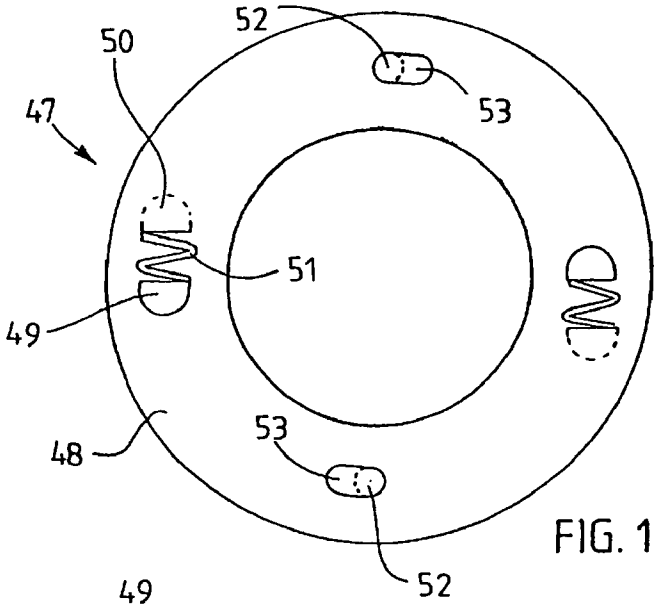
FIG. 12 shows the centre adjuster from one end.
Figure 13:
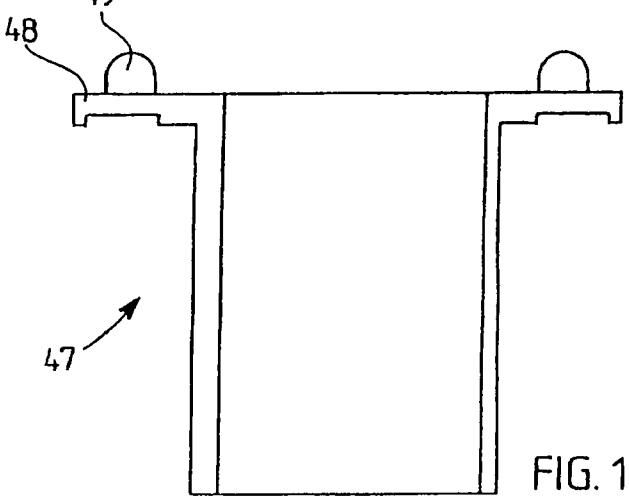
FIG. 13 is a sectional view of the centre adjuster.

A centre adjuster 47 of the eccentric arrangement 11, 12 shown especially in FIGS. 11 to 13 is preferably arranged between the eccentric part 8 and bearing 9 of the power shaft 5 to maintain a constant contact point between the inner casing 3 and eccentric ring 11. In this example, the adjusting system has a spring seat 49 in the side flange 48 of the centre adjuster 47, a spring seat 50 at the end of the inner casing 3 and a spring 51 between them, and the spring 51 pushes the centre adjuster 47 forward on the eccentric part 8 making the eccentric ring 11 press against the inner casing 5. There are preferably two of these systems 49 to 51, as shown in FIGS. 11 to 13. The rotating rate of the adjuster 47 is naturally the same as that of the power shaft 5, because they are connected to each other. The end of the inner casing 3 has locking pins 52 that work together with locking openings 53 of the side flange 48 of the adjuster 47 and prevent the eccentric ring 11 from "opening" in relation to the inner ring 3. When the pin 52 is at the front edge of the locking opening 53 with respect to the rotating direction of the power shaft 5, the above-mentioned contact point remains constant.

The eccentricity of the centre adjuster 47 is small, which is why the force of the springs 51 toward the eccentric ring 11 is considerable. A small eccentricity of the centre adjuster 47 is preferable, since the force of the hydraulic fluid produces only a small load to it. Alternatives based on for instance hydraulic or centrifugal forces or combinations thereof can naturally be found for the technical implementation of this adjusting system.

With reference to FIGS. 14 to 17, the hydraulic motor described above works as follows.

Figure 14B:
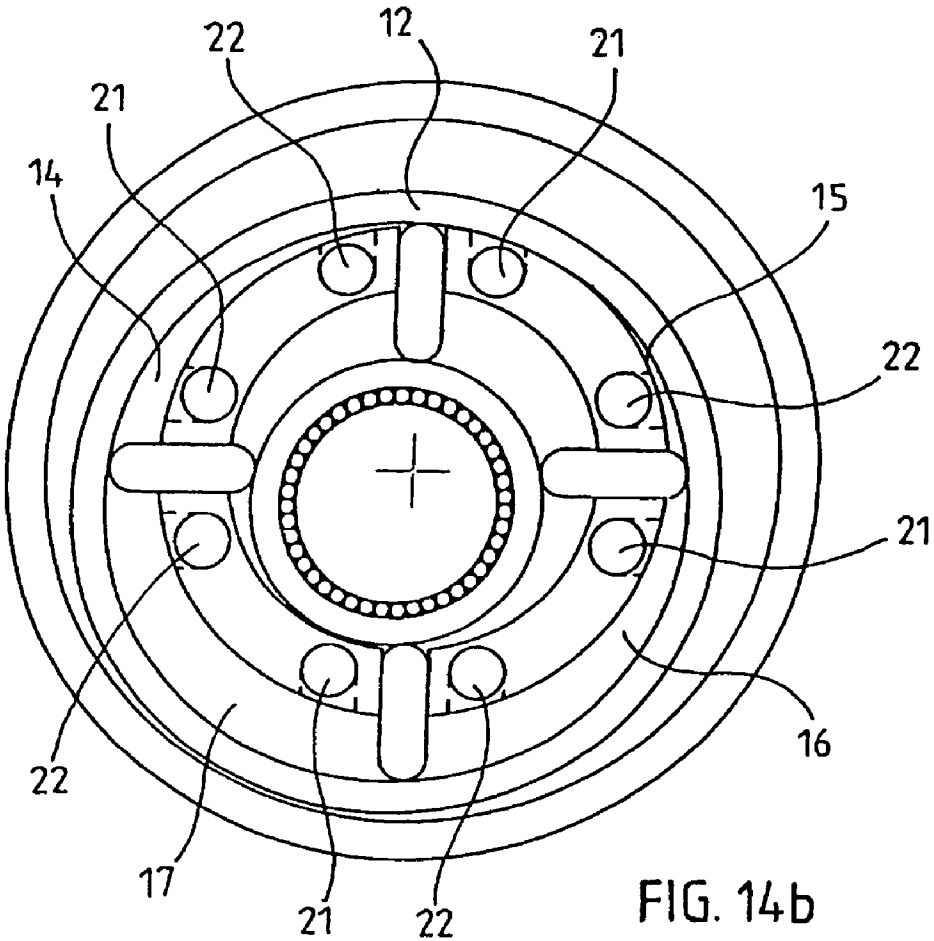
FIGS. 14 to 17 show the different stages of the operation of the motor.
Figure 14A:
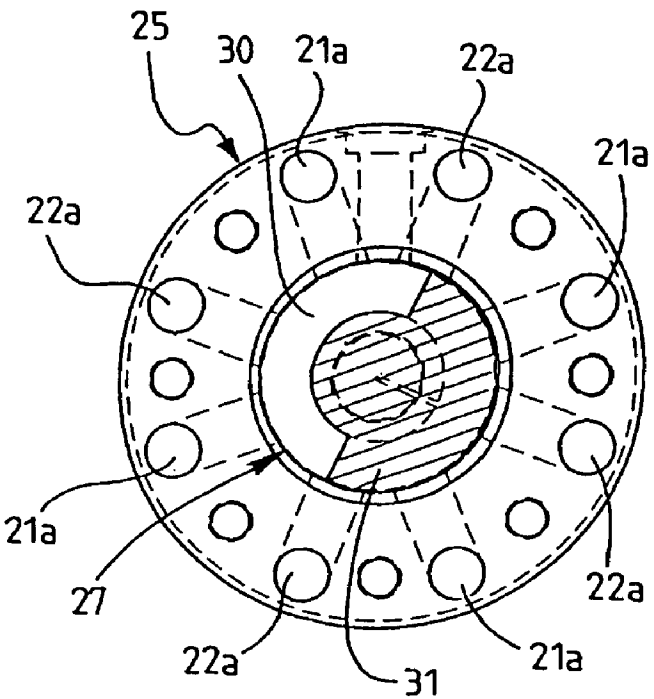

In FIG. 14*b*, the intake channel 21 of the upper left chamber 14 is open and the outlet channel 22 is closed, i.e. hydraulic fluid flows into the chamber 14 and the chamber 14 is thus at a pressure stage. The intake channel 21 of the upper right chamber 15 is open and the outlet channel 22 is closing, i.e. the chamber 15 is at a change stage, in which hydraulic fluid has flown out of the chamber 15 and hydraulic fluid will soon begin to flow into it again. The intake channel of the lower right chamber 16 is closed and the outlet channel 22 is open, i.e. the chamber 16 is at the discharge stage of hydraulic fluid. The intake channel 21 of the lower left chamber 17 is closing and the outlet channel 22 will open in a while, i.e. the chamber 17 is at the end of the pressure stage.

Figure 15B:
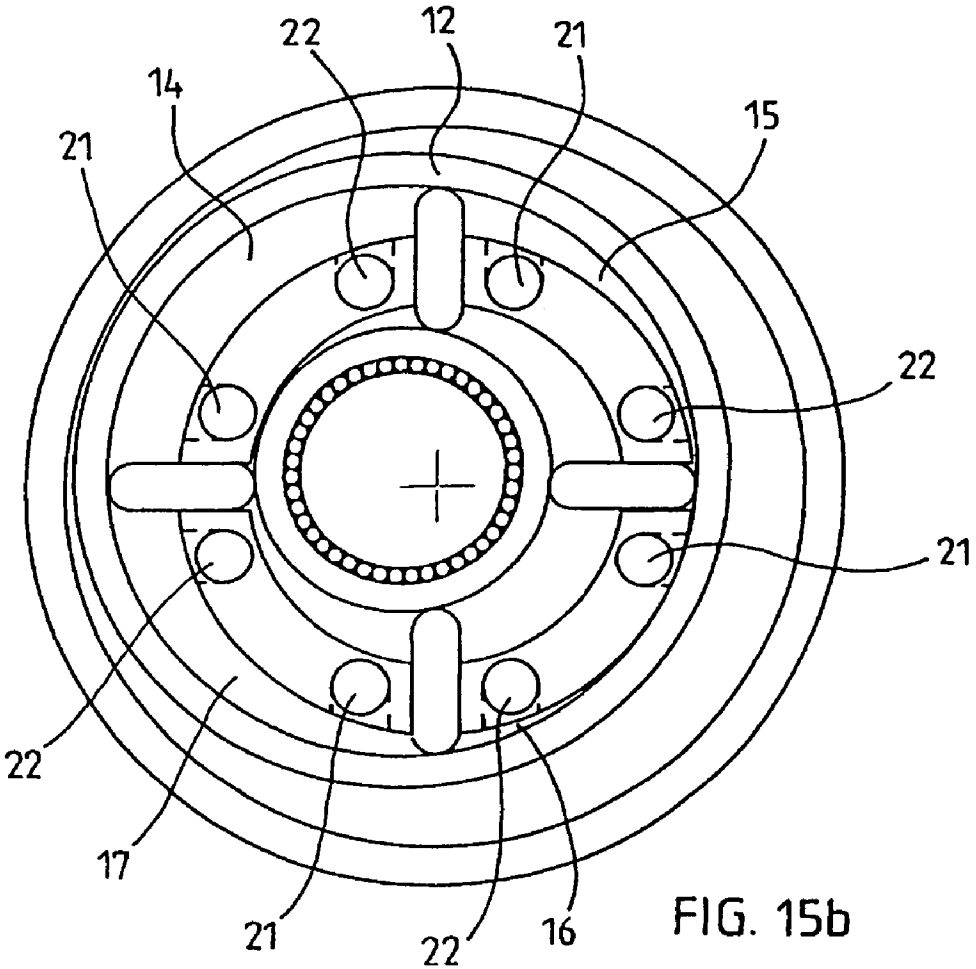
Figure 15A:
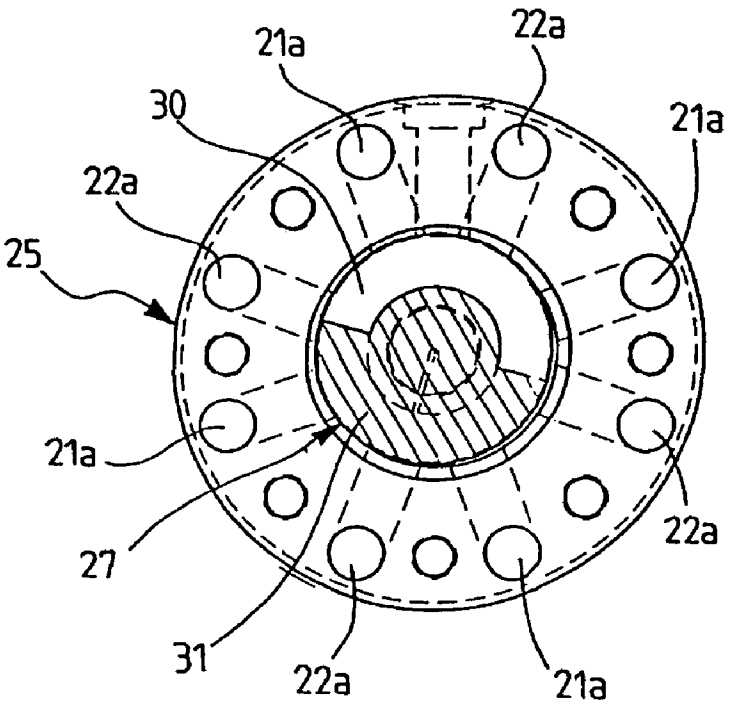

In FIG. 15*b*, the intake channel 21 of the upper right chamber 15 is open and the outlet channel 22 is closed, i.e. hydraulic fluid flows into the chamber 15 and the chamber 15 is thus at a pressure stage. The intake channel 21 of the lower right chamber 16 is open and the outlet channel 22 is closing, i.e. the chamber 16 is at a change stage, in which hydraulic fluid has flown out of the chamber 16 and hydraulic fluid will soon begin to flow into it again. The intake channel of the lower left chamber 17 is closed and the outlet channel 22 is open, i.e. the chamber 17 is at the discharge stage of hydraulic fluid. The intake channel 21 of the upper left chamber 14 is closing and the outlet channel 22 will open in a while, i.e. the chamber 17 is at the end of the pressure stage.

Figure 16B:
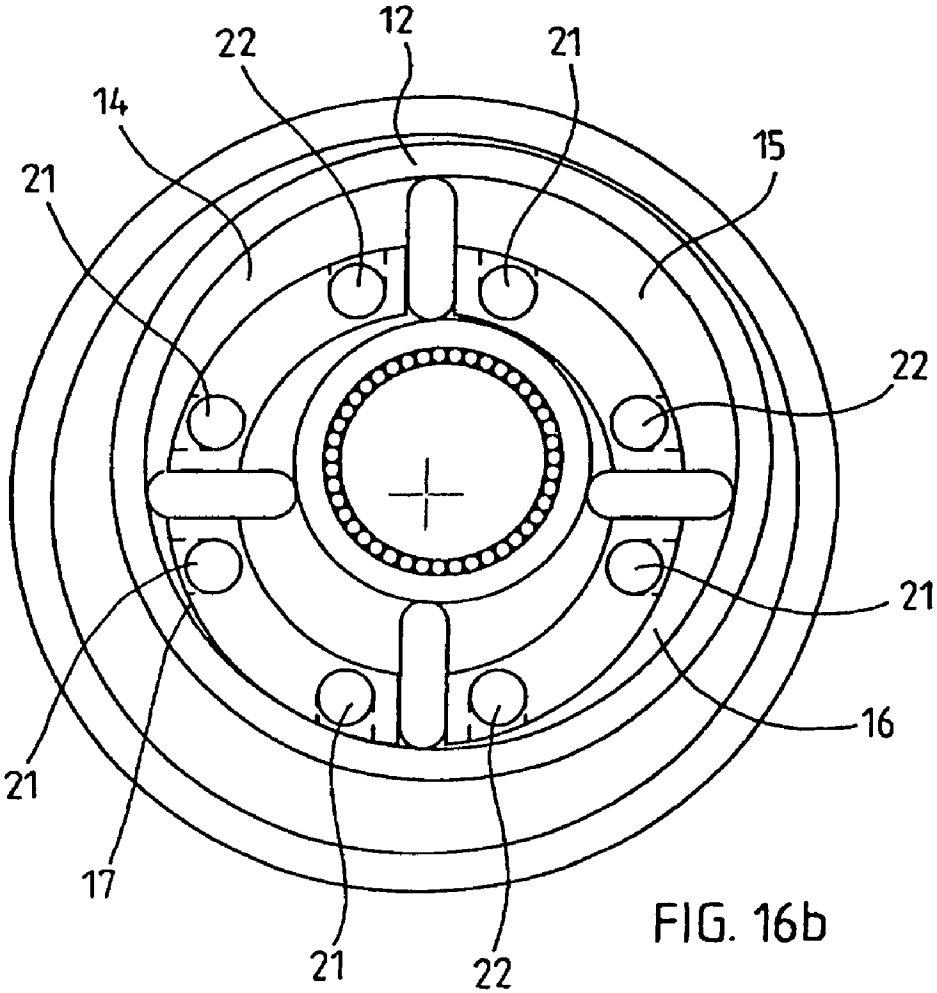
Figure 16A:
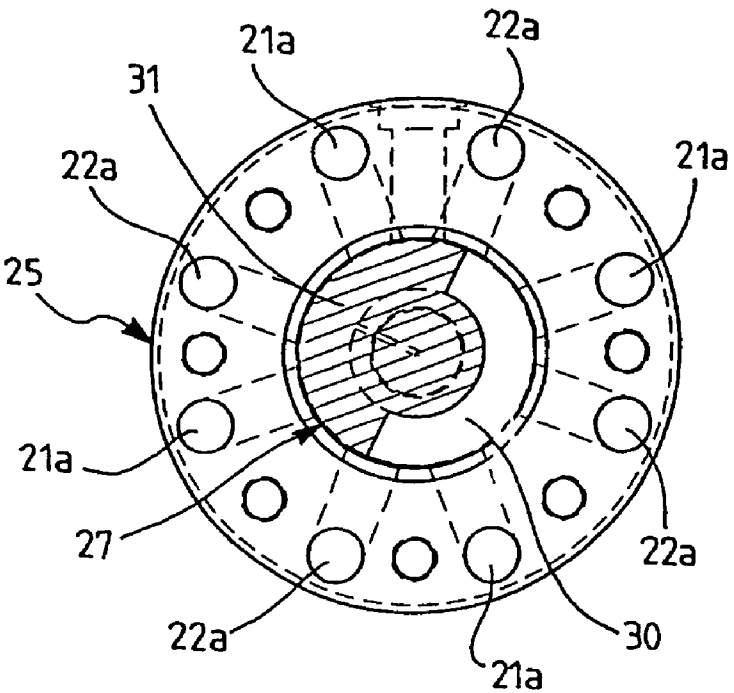

In FIG. 16*b*, the intake channel 21 of the lower right chamber 16 is open and the outlet channel 22 is closed, i.e. hydraulic fluid flows into the chamber 16 and the chamber 16 is thus at a pressure stage. The intake channel 21 of the lower left chamber 17 is open and the outlet channel 21 is closing, i.e. the chamber 17 is at a change stage, in which hydraulic fluid has flown out of the chamber 17 and hydraulic fluid will soon begin to flow into it again. The intake channel of the upper left chamber 14 is closed and the outlet channel 22 is open, i.e. the chamber 14 is at the discharge stage of hydraulic fluid. The intake channel 21 of the upper right chamber 15 is closing and the outlet channel 22 will open in a while, i.e. the chamber 15 is at the end of the pressure stage.

Figure 17B:
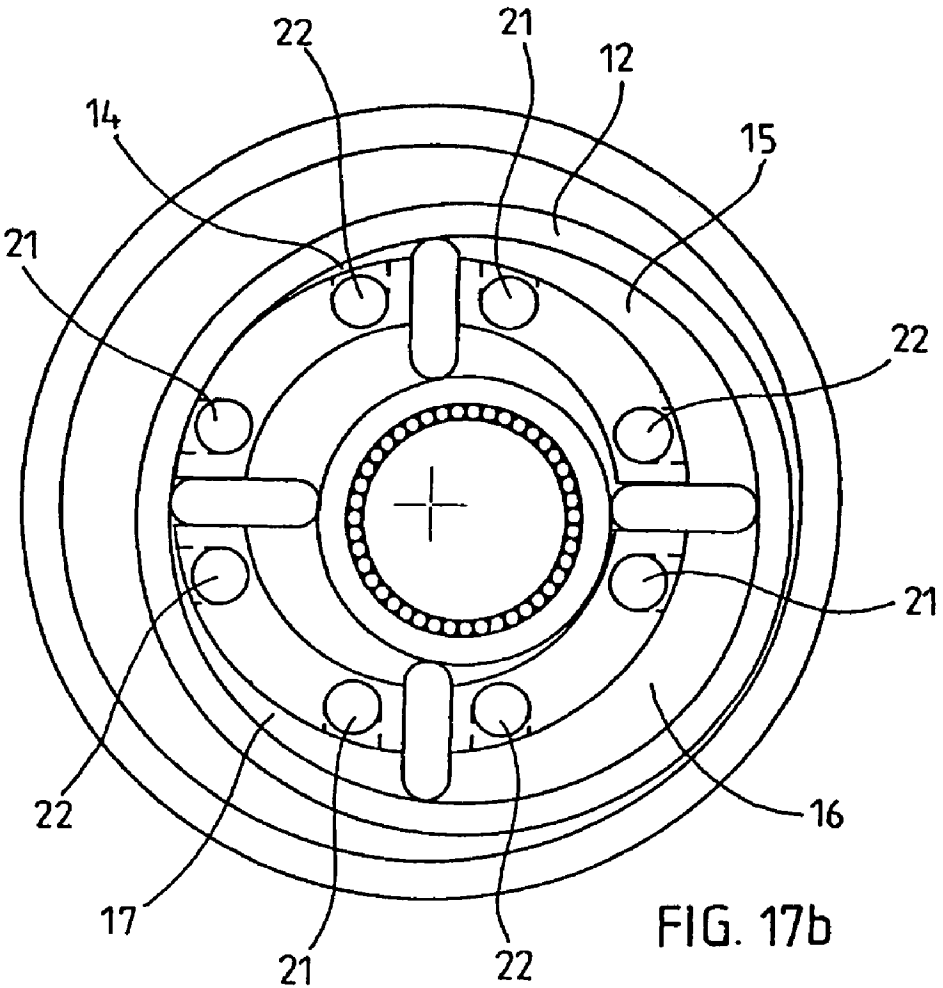
Figure 17A:
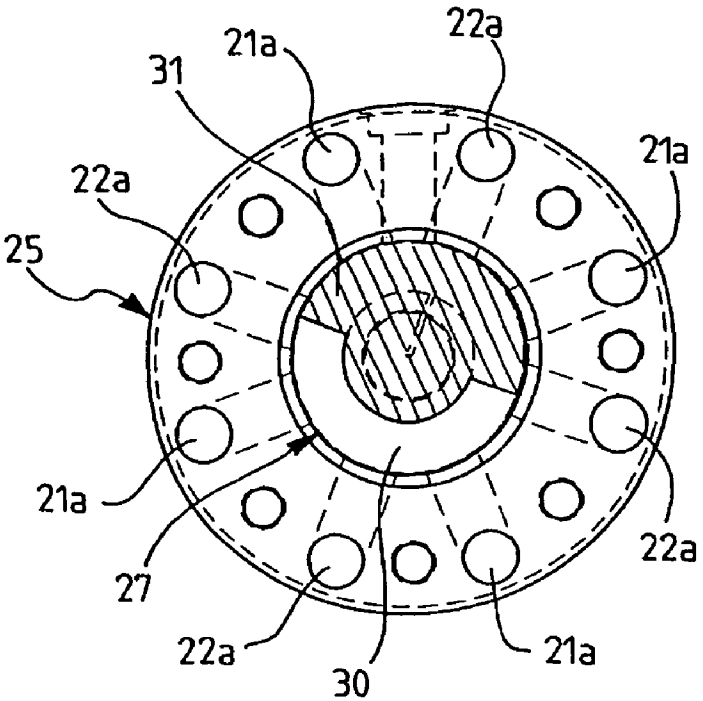

In FIG. 17*b*, the intake channel 21 of the lower left chamber 17 is open and the outlet channel 22 is closed, i.e. hydraulic fluid flows into the chamber 17 and the chamber 17 is thus at a pressure stage. The intake channel 21 of the upper left chamber 14 is open and the outlet channel 21 is closing, i.e. the chamber 14 is at a change stage, in which hydraulic fluid has flown out of the chamber 14 and hydraulic fluid will soon begin to flow into it again. The intake channel 21 of the upper right chamber 15 is closed and the outlet channel 22 is open, i.e. the chamber 15 is at the discharge stage of hydraulic fluid. The intake channel 21 of the lower right chamber 16 is closing and the outlet channel 22 will open in a while, i.e. the chamber 16 is at the end of the pressure stage.

This way, the hydraulic motor of the invention has performed one work cycle and the stages of another work cycle will begin again from the stage according to FIG. 14*b*.

FIGS. 14*a* to 17*a* in turn describe, how the ring parts 30 and 31 of the synchronizing drum 27 of the feeding apparatus 25 close and open the channels 21*a* and 22*a* of the feeding apparatus leading to the intake and outlet openings 21 and 22 of the motor in accordance with the stages shown in FIGS. 14*b* to 17*b*.

An intake and outlet line (or pressure and return line) 21, 21*a* and 22, 22*a* thus leads to every pressure chamber 14 to 17 and the lines are divided in such a manner that during a working stage, the outlet line 22, 22*a* is closed with the exception of the start of the pressure stage, during which both the intake and the outlet lines 21, 21*a* and 22, 22*a* are open so that a counter pressure cannot be generated on the other side of the 0 point, where a discharge stage is ongoing at this time.

Pressure is fed to the pressure chamber 14 to 17 when its volume is at its smallest and the chamber 14 to 17 begins to expand and thus take the eccentric ring 12 towards its maximum value, at which its axis angle is perpendicular to the pressure chamber 14 to 17, i.e. the chamber 14 to 17 is at its maximum size. Next, the intake line 21, 21*a* closes and the return line 22, 22*a* opens. The pressure stage of the neighbouring chamber 14 to 17 again rotates the eccentric ring 12 towards its maximum value, in which case the volume of the previous chamber 14 to 17 decreases and oil is forced to exit from the chamber 14 to 17. The pressure stages follow a linearly rotating movement. The rotating direction of the motor can, if desired, be changed, in which case the intake line 21, 21*a* is changed to the outlet line and the outlet line 22, 22*a* to the intake line, i.e. the hydraulic fluid is rotated in the reverse direction.

The above description of the invention is only intended to illustrate the basic idea of the invention. It is, however, apparent to a person skilled in the art that this basic idea can be implemented in many different ways. Thus the invention and its embodiments are not limited to the examples described above, but they and their details may vary considerably within the scope of the attached claims. Thus, the number of pressure chambers, for instance, is not limited to the four mentioned in the example case, but there may be two or more, as necessary in each case. It is also possible to use the motor of the invention as a pump.

The invention claimed is:

1. A hydraulic motor having a non-rotating annular outer casing, moving eccentric means inside the outer casing, a power shaft connected to the eccentric means and rotatable thereby, a pressure chamber arrangement communicating with the eccentric means for moving the eccentric means and thus rotating the power shaft by hydraulic fluid, steam or pressurized air led into and removed from the pressure chamber arrangement, and a non-rotating annular inner casing inside the non-rotating annular outer casing, wherein the eccentric means comprise an eccentric part formed in the power shaft, a first eccentric ring between the outer casing and the inner casing, and a second eccentric ring mounted with bearings around the eccentric part of the power shaft and connected fixedly and concentrically to the first eccentric ring, whereby the pressure chamber arrangement is located between the first eccentric ring and the inner casing in such a manner that the first eccentric ring drives the power shaft through the second eccentric ring, and the first and second eccentric rings form a substantially non-rotating entity that only performs an eccentric movement and makes the power shaft rotate by this eccentric movement.

2. A hydraulic motor as claimed in claim 1, wherein the pressure chamber arrangement is divided into at least two equal-sized parts by divider means arranged through the inner casing and arranged to be in close contact with the inner surface of the first eccentric ring and the outer surface of the second eccentric ring and to move radially in relation to the inner casing guided by the eccentric rings.

3. A hydraulic motor as claimed in claim 1, wherein to balance the eccentric forces, a balancing arc fastened to the power shaft is arranged between the outer casing and the eccentric ring, the arc being located on the opposite side of the power shaft in relation to the eccentric part of the power shaft.

4. A hydraulic motor as claimed in claim 1, wherein intake and outlet channels are arranged to the inner casing for leading hydraulic fluid, steam or pressurized air to the pressure chamber arrangement and away from it.

5. A hydraulic motor as claimed in claim 4, wherein a feeding apparatus connected to the intake and outlet channels is fastened to the side of the motor to rotate hydraulic fluid, steam or pressurized air through the pressure chamber arrangement.

6. A hydraulic motor as claimed in claim 5, wherein the feeding apparatus is a mechanical rotating valve.

* * * * *

UNITED STATES PATENT AND TRADEMARK OFFICE

CERTIFICATE OF CORRECTION

PATENT NO. : 7,192,264 B2
APPLICATION NO. : 10/511141
DATED : March 20, 2007
INVENTOR(S) : Tapio Viitamaki It is certified that error appears in the above-identified patent and that said Letters Patent is hereby corrected as shown below:

On the title page:
Please delete the following:

(22) PCT Filed: Apr. 17, 2004 and replace with the following:

(22) PCT Filed: Apr. 17, 2003

Signed and Sealed this

Third Day of July, 2007

JON W. DUDAS
*Director of the United States Patent and Trademark Office*